US005911202A

United States Patent [19]

Kato

[11] Patent Number: 5,911,202

[45] Date of Patent: Jun. 15, 1999

[54] TWO-CYCLE ENGINE

[75] Inventor: Kinichi Kato, Chiba, Japan

[73] Assignee: Tanaka Kogyo Co., Ltd., Narashino, Japan

[21] Appl. No.: 09/059,758

[22] Filed: Apr. 14, 1998

[30] Foreign Application Priority Data

Sep. 2, 1997 [JP] Japan ..... 9-251404

[51] Int. Cl.[6] ..... F02B 75/02

[52] U.S. Cl. ..... 123/65 PD

[58] Field of Search ..... 123/193.6, 65 W, 123/65 PD

[56] References Cited

U.S. PATENT DOCUMENTS 3,858,562 1/1975 Lanpheer ..... 123/65 PD

FOREIGN PATENT DOCUMENTS 59-28628 2/1984 Japan .

*Primary Examiner*—Noah Kamen

*Attorney, Agent, or Firm*—Frishauf, Holtz, Goodman, Langer & Chick

[57] ABSTRACT

A deflector comprising a U-shaped embossed part is provided on the top surface of the loop scavenging type two-cycle engine in such a direction that the opening of the U-shaped boss is on the side of the exhaust port of the cylinder, and a combustion chamber is shaped such that the U-shaped deflector of the piston is fitted therein and is placed in the cylinder head opposite the said top surface of the piston. When the piston rises and the deflector is fitted inside the combustion chamber of the cylinder head, there is formed a squish zone between the outside area of the deflector at the top surface of the piston and the cylinder head for pressing the air-fuel mixture into the combustion chamber, to thereby decrease the emission of unburned gas containing harmful hydrocarbons and the improve the combustion efficiency for higher output.

8 Claims, 3 Drawing Sheets

TWO-CYCLE ENGINE

BACKGROUND OF THE INVENTION AND RELATED ART STATEMENT

The present invention concerns two-cycle engine, and more particularly to improvements made to loop scavenging type two-cycle engines characterized by the method of scavenging.

Among the prior art loop scavenging type engines, Schnurle type two-cycle engine is well known. The engine charges the air-fuel mixture into a crankcase from a carburetor via an inlet port, and then into a cylinder from a scavenging charge port thereof through a passage provided between the crankcase and the cylinder wall after applying compression force by lowering the top piston in the crankcase. The scavenging charge port for charging the air-fuel mixture opens toward the wall opposite an exhaust port inside the cylinder. Thus, the air-fuel mixture charged into the cylinder from the scavenging charge port climbs up in loops along the wall opposite the exhaust port, is guided into the cylinder head, compressed by rising of the piston and ignited. When combustion of the air-fuel mixture brings the piston down, the exhaust gas is discharged out of the cylinder through the exhaust port and new air-fuel mixture is charged into the cylinder from the scavenging charge port so that a portion of the exhaust gas remaining inside the cylinder is efficiently and completely discharged outside the cylinder from the exhaust port.

The Schnurle type two-cycle engine is advantageous in that the air-fuel mixture charged into the cylinder from the charge port climbs up in loops toward the cylinder head along the wall facing the exhaust port, and conducts scavenging in an efficient manner. However, in spite of the above mentioned advantages, this type engine is defective in that the air-fuel mixture still in the liquid state directly blows out from the exhaust port without burning immediately after it is charged into the cylinder from the charge port, and causes high hydrocarbon (HC) emission, harming the environment.

Such problems appear probably due to the following reasons. With this type engine, efficient scavenging is attempted by letting flow in loops the air-fuel mixture charged into the cylinder from the charge port toward the cylinder head along the wall opposite the exhaust port. In order for the air-fuel mixture to smoothly flow toward the wall opposite the exhaust port, the piston top surface should be smooth and free of irregularities. If the top surface is smooth, the air-fuel mixture from the charge port is discharged toward the direction the charge port faces, and becomes dispersed immediately after it is discharged in the cylinder, creating a layer which flows over a long distance in loops along the inner wall surface of the cylinder and another layer inside the first layer which flows toward the center of the cylinder. The second layer leaks outside from the exhaust port without burning in the liquid state.

Japanese Utility Model Kokai No. Sho59-28628 discloses a system to overcome the problem of a portion of the air-fuel mixture leaking from the cylinder through the exhaust port in the liquid state. According to this system, the air-fuel mixture suctioned into the cylinder from the scavenging charge port is not allowed to flow in loops toward the cylinder head along the cylinder inner wall but is directed toward the cylinder head directly through the center of the cylinder from immediately above the piston.

This system provides a guide passage for the air-fuel mixture at the top surface of the piston connecting the side area and the top surface of the piston, passes the air-fuel mixture from the scavenging charge port opened on the inner wall of the cylinder through the guide passage and directly sends the mixture toward the cylinder head, which is positioned above the piston top surface, from the outlet port of the said guide passage acting substantially as a scavenging port.

The system may be suitable for efficiently guiding the air-fuel mixture toward the cylinder head through the cylinder center since the mixture passes from the outlet port of the scavenger guiding passage, said outlet port acting as an scavenging port and opening over the top surface of the piston. The system, however, entails the problem in that the flow of the air-fuel mixture passing through the cylinder center alone cannot secure scavenging all the exhaust gas generated after combustion of the air-fuel mixture, leaving a portion of the exhaust gas inside the cylinder. The system is further defective in that the area of the piston top surface increases because of a hole bore from the side to the top of the piston as a guiding passage for the scavenging air, and that the volume of the combustion chamber formed between the piston head and the cylinder head becomes larger, thereby reducing the compression ratio inside the cylinder and deteriorating the combustion efficiency.

The above mentioned Japanese UM Kokai Sho59-28628 also discloses a construction for a scavenging system wherein a depression or a groove shaped like the letter V when viewed from above is provided on the periphery of the piston top surface as a means for efficiently flowing in loops the air-fuel mixture charged into the cylinder from the scavenger charger port, and the air-fuel mixture charged into the cylinder from the scavenging port is guided by the V-shaped groove on the periphery of the piston top surface toward the wall opposite the exhaust port.

Since this system also forcibly guides the air-fuel mixture charged into the cylinder from the scavenger port toward the wall opposite the exhaust port by the V-shaped groove, it is defective in that the volume of the combustion chamber formed between the piston head and the cylinder head increases by the additional volume of the V-shaped groove provided on the periphery of the piston top surface, the compression ratio inside the cylinder does not become high, and the combustion efficiency is poor.

SUMMARY OF THE INVENTION

The present invention was contrived in view of the problems of the conventional loop scavenging two-cycle engines as mentioned above, and aims to offer a novel loop scavenging two cycle engine wherein the air-fuel mixture charged into the cylinder from the scavenging charge port can be efficiently passed in loops inside the cylinder, the combustion chamber opposite the piston top surface has an optimum volume and shape, the compression ratio inside the cylinder is high, and the combustion efficiency is excellent.

The loop scavenging two-cycle engine according to the present invention is provided with a deflector shaped with a projecting U-shaped boss on the piston top surface in such a way that the opening of the letter U is positioned toward the exhaust port side of the cylinder, and with a combustion chamber shaped so that said U-shaped deflector can be fitted snugly into the cylinder head.

In the engine so constructed, the air-fuel mixture charged into the cylinder from the scavenging charge port crashes against the side of the U-shaped projecting boss on the piston top surface and is guided toward the inner wall opposite the exhaust port, and creates only the layer which flows in loops toward the cylinder head along the inner wall.

This not only solves the problem of a portion of the air-fuel mixture leaking from the exhaust port in the liquid state without burning, but also effectively discharges exhaust gas by creating an appropriate scavenging flow in the cylinder.

This engine is further provided with a combustion chamber shaped in such a way that said U-shaped deflector fits inside the cylinder head so that the U-shaped deflector and the top surface of piston surrounded by the deflector are completely enveloped inside the combustion chamber. Thus, a good squish effect is created when the air-fuel mixture above the piston and outside the deflector is pushed into the combustion chamber, thereby raising the compression ratio inside the cylinder and improving the combustion efficiency.

DETAILED DESCRIPTION OF THE PREFERRED EMBODIMENT

Figure 1:
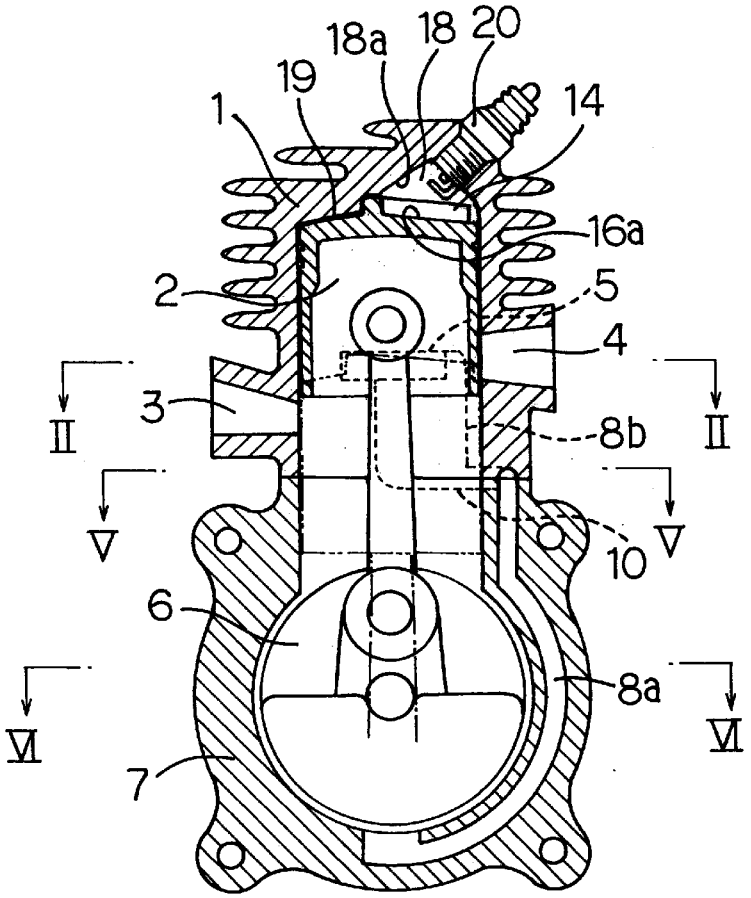
FIG. 1 is a sectional view of the two-cycle engine in its entirety according to the present invention cut along the longitudinal direction with the piston raised.

Construction of the two-cycle engine according to the present invention is now explained by referring to the preferred embodiment shown in the drawings. As shown in FIG. 1, the engine has an inlet port 3 to suction the air-fuel mixture into a cylinder 1 and an exhaust port 4 to exhaust combustion gas. When a piston 2 rises, the mixture guided into the cylinder 1 from the inlet port 3 is charged into a crank chamber 6 and compressed therein by lowering of the piston 2.

A crank case 7 having the crank chamber 6 inside is provided with a passage 8*a* extending upward from the bottom of the crank chamber 6 through the wall on one side of the crank case 7. The cylinder 1 has passages 8*b* extending vertically upward from the position connecting with said passage 8*a* of the crank case 7 through the side wall on both sides of the cylinder 1. The upper ends of these passages 8*a* and 8*b* connect with scavenging charge ports 5 opened on the wall on both sides of the cylinder 1.

Figure 6:
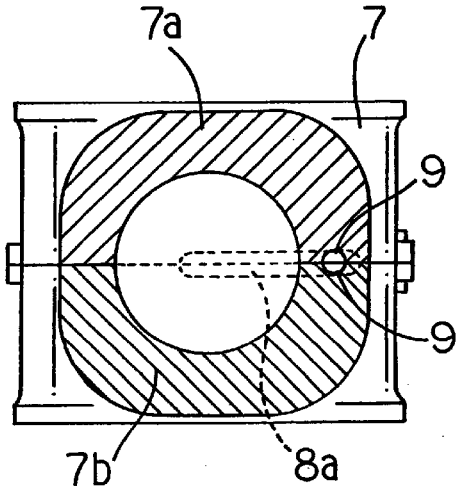
FIG. 6 is a sectional view along the line VI—VI in FIG. 1.

As shown in FIG. 6, the passage 8*a* provided inside the side wall of the crank case 7 is formed by a symmetric pair of concave grooves 9 extending upward from the bottom of the crank chamber 6 on the contacting surface of the symmetric pair of case members 7*a*, 7*b* which constitute the crank case 7.

Figure 2:
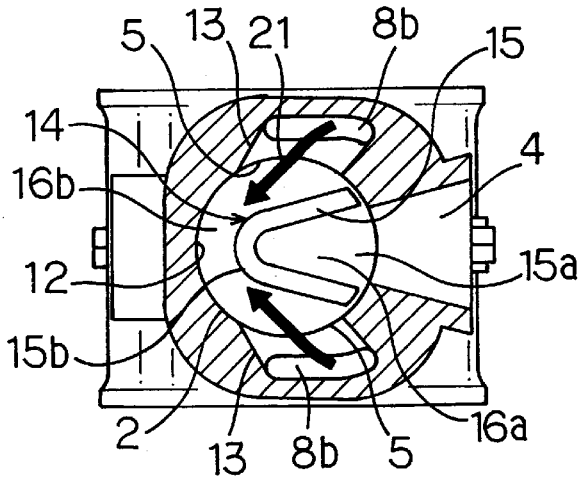
FIG. 2 is a sectional view along the line II—II in FIG. 1.
Figure 5:
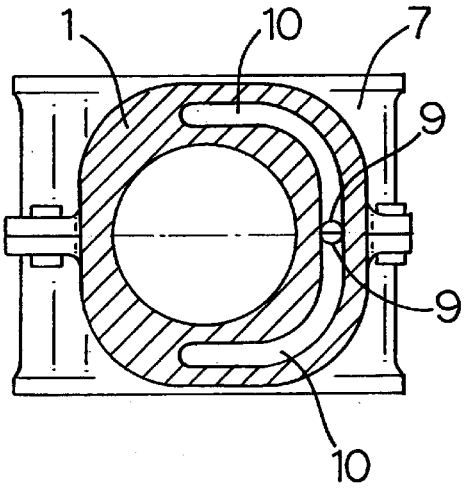
FIG. 5 is a sectional view along the line V—V in FIG. 1.

As shown in FIGS. 1 and 5, the passages 8*b* provided inside the wall on both sides of the cylinder 1 are positioned above a pair of right and left concave grooves 10 provided horizontally and branching into the largest curve possible on both sides of the cylinder 1 connecting with the passage 8*a* on the side of the crank case 7. The passages 8*b* extend vertically upward through the wall on both sides of the cylinder 1 with a hole having an elongated section as shown in FIG. 2 from the said horizontal concave grooves 10. The tips of the passages 8*b* connect with the scavenging charge ports 5 opened on the wall on both sides of the cylinder 1. As shown in FIG. 2, these ports 5 are connected via the passages 13 inclined toward the inner wall 12 opposite the exhaust port 4 inside the cylinder 1.

Figure 3:
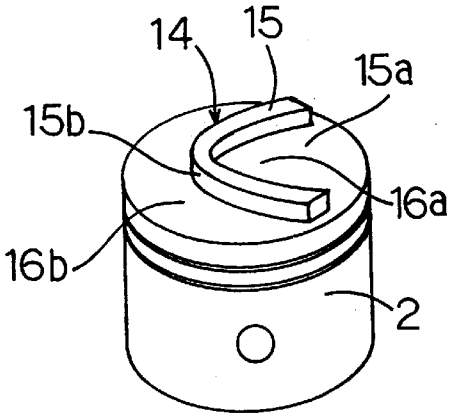
FIG. 3 is a perspective view of the piston showing the shape of a deflector provided on the piston head.
Figure 4:
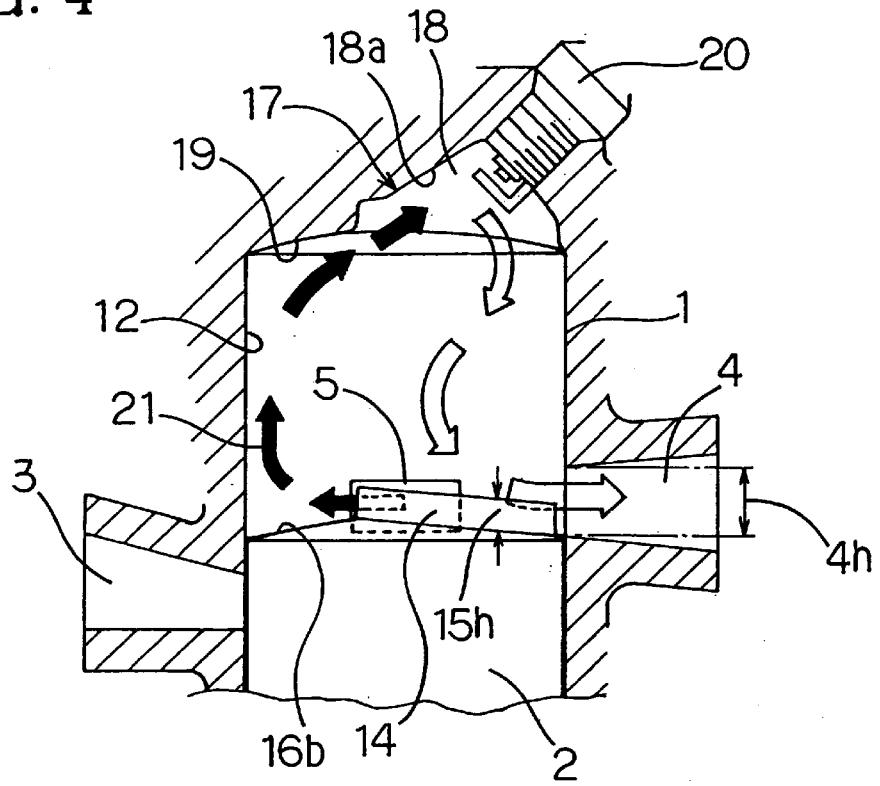
FIG. 4 is a sectional view cut along the longitudinal direction of the cylinder, showing the direction of the flow inside the cylinder of the air-fuel mixture suctioned through the scavenging charge port.

As shown in FIGS. 2 through 4, there is provided a deflector 14 at the top surface of the piston 2 in the cylinder 1 to direct the air-fuel mixture flow introduced from the scavenging charge ports 5 toward the inner wall 12 opposite the exhaust port 4 in the cylinder 1. The deflector 14 comprises a embossed part shaped like the letter U when viewed from above, projecting on the top surface of the piston 2. The opening 15*a* of the U-shaped boss 15 is positioned such that it is on the side of the exhaust port 4 of the cylinder 1. It is preferable that the middle portion of the U-shaped boss 15 of the deflector 14 has a smoothly curved line 15*b*, and other portion of the boss 15 has somewhat slant lines as in the letter V. The top surface of the piston 2 is sectioned by the U-shaped boss 15 of the deflector 14 into the inside area 16*a* and the outside area 16*b*.

The boss 15 constituting the U-shaped deflector 14 has a square or rectangular cross section so that the inner and outer sides thereof form substantially vertical walls in respect of the top surface of the piston 2. As shown in FIG. 4, the height 15*h* of the convex wall 15 should preferably be about one half of the longitudinal length 4*h* of the exhaust port 4. The outer side of the boss 15 forming the letter U are positioned inside the passage of the air-fuel mixture 21 to be introduced from the scavenging charge ports 5 as shown by the arrows in FIG. 2, and guide the mixture 21 toward the inner wall 12 opposite the exhaust port 4 in the cylinder 1 while flowing over the outside area 16*b* along the respective side of the boss 15.

On the other hand, the cylinder head 17 opposite the top surface of the piston 2 provided with the deflector 14 is provided with a dome-shaped combustion chamber 18 designed to be fit into the inside area 16*a* surrounded by the deflector 14 and the boss 15 of the deflector 14. As shown in FIG. 1, the inner periphery of the combustion chamber 18 fits the configurations of the outer side and the top surface of the deflector 14 so that when the piston 2 rises and reaches the top dead center, the deflector 14 and its inside area 16*a* are fitted inside and form a space for compressing the air-fuel mixture 21.

The combustion chamber 18 is positioned in such a way that the axial direction of an ignition plug 20 is inclined toward the direction facing the flow of the mixture 21 which flows from the direction of the inner wall 12 opposite the exhaust port 4 in the cylinder 1, and the ceiling 18*a*, which corresponds to the center of the inside area 16*a* surrounded by the deflector 14, of the combustion chamber 18 is shaped so that the air-fuel mixture 21 flowing from the direction of the inner wall 12 in the cylinder 1 may be guided easily toward the ignition plug 20.

In the area other than the combustion chamber 18 in the cylinder head 17 is provided ceiling 19 which corresponds to the outside area 16*b* on the top surface of the piston 2. When the piston 2 rises near the top dead center and ignition is about to start, there is formed a squish zone over the opposing surfaces of the outside area 16*b* of the top surface of the piston 2 and the ceiling 19 of the cylinder head 17 to press the air-fuel mixture 21 above the piston into the combustion chamber 18 while causing turbulence in the air.

In a two-cycle engine of the above construction, the air-fuel mixture is suctioned into the crank chamber 6 from the suction port 3 by the rising of the piston 2, is compressed inside the crank chamber 6 by the lowering of the piston 2, passes the scavenging passages 8*b* provided in the cylinder 1 from the scavenging passage 8*a* provided in the crank case 7, and charged into the cylinder 1 from the scavenging charge ports 5. Since the air-fuel mixture 21 suctioned into the crank chamber 6 from the suction port 3 is a mist of fuel particles dispersed in the air, evaporation of the liquid fuel by the heat of the crank case 7 is promoted while the liquid fuel is compressed in the crank chamber 6 and sent upward from the bottom of the crank chamber 6 through the passage 8*a* provided inside the wall of the crank case 7.

Figure 7:
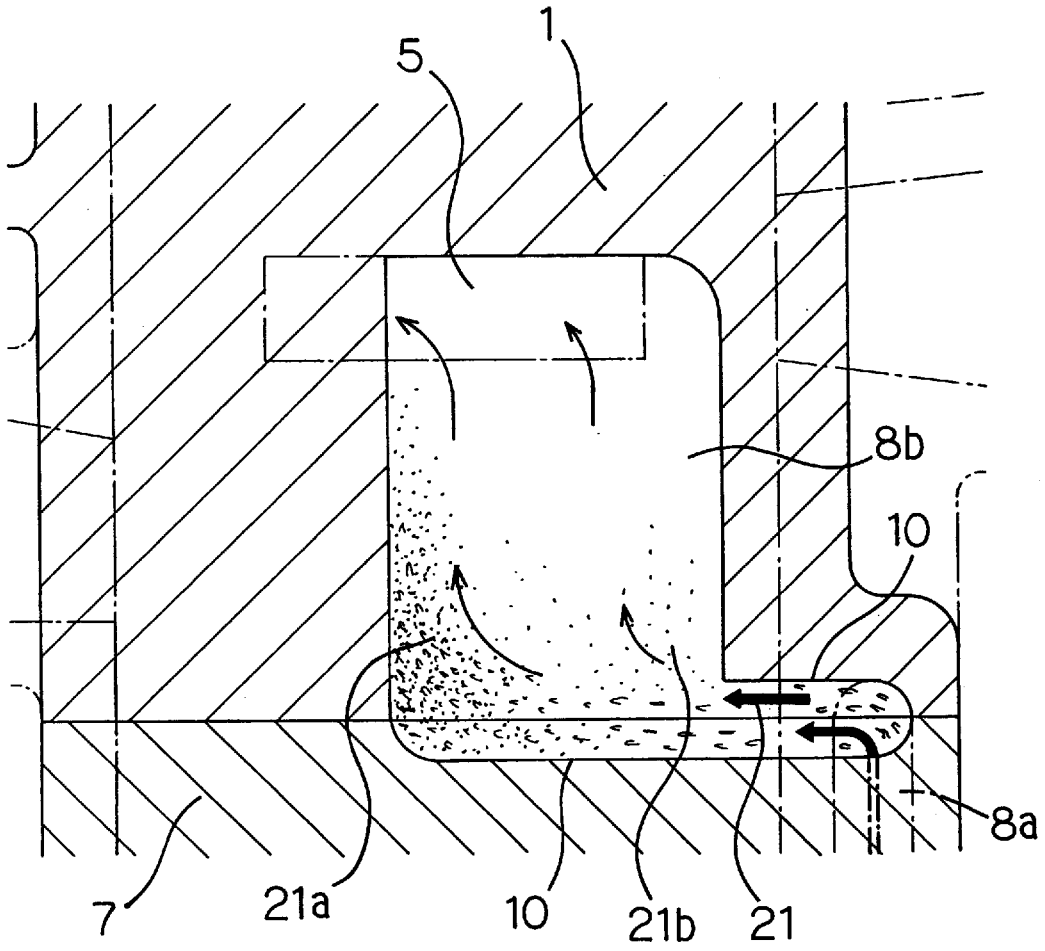
FIG. 7 is a partial sectional view showing the shape of scavenging passage between the crank chamber and the cylinder.

The passage 8*a* provided inside the wall of the crank case 7 connects with the passages 8*b* provided in the wall on both sides of the cylinder 1 above, and the air-fuel mixture 21 blown up from the lower passage 8*a* is charged into the horizontal concave grooves 10 on the contact surface of the crank case 7 and the cylinder 1. As shown in FIG. 7, of the air-fuel mixture 21 blown in the horizontal direction inside the concave grooves 10, the mixture 21*a* of larger mass containing lots of fuel particles is pushed toward the wall on the left side of the concave groove 10 and crash into the wall. As a passage 8*b* having an elongated section extending vertically upward is provided over the concave grooves 10, the mixture 21*a* of larger mass and containing more fuel particles which crashed into the wall on the left end of the concave groove 10 rises along the left side of the passage 8*b* and is blown toward the inside wall 12 from a position far from the exhaust port 4 of the scavenging charge ports 5 shown in FIG. 2.

On the other hand, the air-fuel mixture 21*b* with smaller mass and less fuel particles flows toward the direction of the upper scavenging charge ports 5 by passing through the passage 8*b* from the right hand side of the concave groove 10 shown in FIG. 7. Outside the scavenging charge ports 5 is the boss 15 of the deflector 14 which stops the mixture from riding over the boss 15 and flowing toward the inside area 16*a*, thus preventing leakage from the exhaust port 4.

Passing the air-fuel mixture 21 through the passages 8*a*, 8*b* provided in the walls of the crank case 7 and the cylinder 1 and heating or vibrating the mixture mean promoting atomization and evaporation of the liquid fuel and creating air-fuel mixture of a higher density containing a greater amount of fuel particles. This in turn enhances the combustion efficiency and decreases the liquid stage fuel which causes high HC emission. Giving a curved shape to the concave grooves 10 provided horizontally on the contact surface of the top edge of the crank case 7 and the lower edge of the cylinder 1 or bending the connecting part of the concave grooves 10 and the passage 8*b* decrease the resistance toward the air-fuel mixture 21 passing through the passage and prevent lowering of the output.

On the other hand, the air-fuel mixture 21 introduced into the cylinder 1 from the scavenging charge ports 5 crashes into the wall of the deflector 14 and is prevented from flowing toward the inside area 16*a*, most of the mixture is guided toward the inside wall 12 opposite the exhaust port 4 after passing over the outside area 16*b* and flows toward the cylinder head 17. Therefore, there is formed only the layer of the air-fuel mixture 21 of the cylinder 1 flowing in loops along the inner wall of the cylinder, but the flow toward the center of the cylinder does not occur. This remarkably restrains the amount of liquid stage gas leaking from the exhaust port before combustion.

When the piston 2 rises, there is formed a squish zone which gives turbulence on the contacting surface of the outside area 16*a* on the top surface of the piston 2 and the concave groove 19 of the cylinder head 17, and the zone causes turbulence and presses the air-fuel mixture 21 above the piston into the combustion chamber 18. As the deflector 14 fits into the combustion chamber 18, the outer surface of the deflector 14 and the inner periphery of the combustion chamber 18 engage each other fitly, securely envelop the air-fuel mixture 21 into the space formed between the combustion chamber 18 and the inside area 16*a* of the deflector 14, and raise the compression ratio. This shortens the distance of the combustion waves at the time of ignition, improves the combustion efficiency, and obtains high output.

What is claimed is:

1. In a loop scavenging type two-cycle engine for compressing an air-fuel mixture inside a crank case and charging the mixture into a cylinder through scavenging charge ports, a deflector comprising:

a U-shaped boss provided on a top surface of a piston of the engine;

wherein said deflector is arranged such that an opening of the U-shaped boss is positioned on a side of an exhaust port of a cylinder of the engine; and wherein said deflector is fitted into a cylinder head opposing the top surface of the piston when the cylinder is in a top dead center position.

2. In the engine according to claim 1, wherein said deflector is arranged to section the top surface of the piston into an inside area and an outside area.

3. In the engine according to claim 2, wherein said deflector and the inside area surrounded by the U-shaped boss are enveloped by a combustion chamber provided inside the cylinder head opposing the top surface of the piston of the engine.

4. In the engine according to claim 2, wherein said deflector is positioned in the engine such that a squish zone is provided around a combustion chamber in the cylinder head for pressing an air-fuel mixture into the combustion chamber corresponding to the outside area of the deflector at the top surface of the piston.

5. In the engine according to claim 1, wherein the U-shaped boss has a height which is about ½ of a height of the exhaust port, and a rectangular cross section such that inner and outer sides of the U-shaped boss comprise a substantially vertical wall with respect to the top surface of the piston.

6. In the engine according to claim 5, wherein said cross section is a square cross section.

7. In the engine according to claim 5, wherein said cross section is a longitudinal rectangular cross section.

8. In the engine according to claim 1, wherein the U-shaped boss has an outer side which is arranged to be positioned inside a passage which guides an air-fuel mixture introduced from a scavenging exhaust port of the cylinder of the engine toward an inner wall opposite the exhaust port in the cylinder.

* * * * *